US012137757B2

(12) United States Patent
Shaffer et al.

(10) Patent No.: US 12,137,757 B2
(45) Date of Patent: Nov. 12, 2024

(54) SHIRT WITH PADDED UPPER TORSO

(71) Applicants: Seth A. Shaffer, Dillsburg, PA (US); Erin E. Shaffer, Dillsburg, PA (US)

(72) Inventors: Seth A. Shaffer, Dillsburg, PA (US); Erin E. Shaffer, Dillsburg, PA (US)

( * ) Notice: Subject to any disclaimer, the term of this patent is extended or adjusted under 35 U.S.C. 154(b) by 33 days.

(21) Appl. No.: 18/119,645

(22) Filed: Mar. 9, 2023

(65) Prior Publication Data

US 2023/0292855 A1 Sep. 21, 2023

Related U.S. Application Data

(60) Provisional application No. 63/319,944, filed on Mar. 15, 2022.

(51) Int. Cl.
*A41D 13/05* (2006.01)
*A41B 1/08* (2006.01)

(52) U.S. Cl.
CPC ..... *A41D 13/0512* (2013.01); *A41B 1/08* (2013.01)

(58) Field of Classification Search
CPC ..... A41B 1/08; A61F 2/52; A41D 13/0512; A41D 1/21; A41D 1/215
See application file for complete search history.

(56) References Cited

U.S. PATENT DOCUMENTS 2,831,193 A 10/1956 Terry
4,873,725 A 10/1989 Mitchell
5,709,000 A 1/1998 Hansen
6,345,392 B1 2/2002 Rios
7,640,598 B1 1/2010 Mallik
D684,727 S 6/2013 Kuever
8,973,163 B1 3/2015 Kuever
11,744,297 B1 * 9/2023 Coggiola-Belza ..... A41C 3/04 450/37
2009/0265831 A1 * 10/2009 Hendrickson ..... A41C 3/08 2/104
2013/0036524 A1 2/2013 D'Ascoli
2016/0066629 A1 3/2016 Marcum
2018/0344487 A1 * 12/2018 Mommers-McCaffrey ..... A41B 1/08
2020/0100918 A1 * 4/2020 Mommers-McCaffrey ..... A61F 2/52
2022/0015553 A1 1/2022 Kaktins
2023/0270189 A1 * 8/2023 Inzer ..... A41D 13/0015 2/115
2023/0292855 A1 * 9/2023 Shaffer ..... A41D 13/0512 2/461
2024/0138494 A1 * 5/2024 Keyport ..... A41D 1/215

* cited by examiner

*Primary Examiner* — Tajash D Patel
(74) *Attorney, Agent, or Firm* — Miller Law Group, PLLC

(57) ABSTRACT

A shirt incorporating a padded torso section formed with padding sewn onto an interior layer of an encompassing shell which in turn is sewn onto the exterior layer of the shell. Additional stitching passing through the padding and the interior and exterior layers of the shell can form a pleasing geometric pattern. The padded torso section provides comfort to the caregiver and to the infant resting on the torso of the caregiver. The padding can be secured to the interior shell member in a detachable manner to permit the removal of the padding from the upper torso section of the shirt. The shirt can be constructed as a nursing shirt, utilizing various forms of fasteners, and having an overlapping cover secured to the torso section to be used as a privacy cover.

20 Claims, 4 Drawing Sheets

10
12
13
14
15
16
17
18
18a
2
2

SHIRT WITH PADDED UPPER TORSO

CROSS-REFERENCE TO RELATED APPLICATIONS

This application claims domestic priority on co-pending U.S. Provisional Patent Application Ser. No. 63/319,944, filed on Mar. 15, 2022, the content of which is incorporated herein by reference.

FIELD OF THE INVENTION

This invention relates generally to a shirt worn by a child caretaker, and more particularly, a shirt with a padded upper torso to provide comfort for a infant being held against the torso by the caretaker.

BACKGROUND OF THE INVENTION

A recommended practice for parents of a newborn or a very young child is to hold the infant against the parent's chest so that the infant can feel the parent's heart beating and obtain comfort therefrom. Infants will often fall asleep in such a position. Furthermore, the parent and child will likely bond while in this position. The upper torso region of an adult human being, male or female, is full of uncomfortable bones, such as the sternum, the clavicle, ribs and the bones forming the shoulders. Moreover, an infant's head bones can also become uncomfortable as they press into the caregiver's bony areas. As a result, the caretaker and infant can become uncomfortable in this position while the infant is lying against the caretaker's bony upper torso.

In U.S. Pat. No. 8,973,163, granted on Mar. 10, 2015, and U.S. Pat. No. D684,727, issued on Apr. 20, 2012, to Linda Kuever, et al, discloses a cover garment formed with shoulder pads that resemble athletic football pads to wear over top of a caregiver's shoulders and upper torso to protect the clothing worn underneath the cover garment from material discharged from the infant being held. Similarly, U.S. Pat. No. 7,640,598, granted on Jan. 5, 2010, to Margot Mallik, discloses a padded chest protector that is intended to cover the upper torso of the caregiver holding an infant child. The padded chest protector is foldable about a stitched centerline to permit carrying of the padded garment in the front or rear of the caregiver. The garment is provided with straps that go around the caregiver's shoulders to keep the garment in place over the upper torso of the caregiver.

U.S. Pat. No. 2,831,193, granted on Oct. 8, 1956, to John Terry depicts a drool guard that covers half of the caregiver's torso with a strip of pliable plastic having an open pocket that corresponds to the collar bone area of the caregiver so that a sponge or other resilient pad is retained to cover the shoulder/collar bone area of the caregiver for the comfort of the infant while being burped. Other pockets in the Terry garment are provided to carry other supplies for the caregiver. In a similar manner, U.S. Pat. No. 4,873,725, granted on Oct. 17, 1989, to Tonia Mitchell teaches a full torso cover garment having multiple pockets for carrying various supplies for the infant being burped. This Mitchell cover garment is made from a thick quilted fabric that provides a soft gentle contact with the skin of the infant being held, but is also absorbent to protect the underlying clothes of the caregiver.

The known prior art teaches a number of different drool guard devices or burp cloths, including U.S. Patent Publication No. 2013/0036524, of Rachel D'Ascoli, published on Feb. 14, 2022, that provides a pair of opposing panels positionable on the upper torso to protect the underlying garments of the caregiver; U.S. Patent Publication No. 2022/0015553, of Jennifer Kaktins, published on Jan. 20, 2022, disclosing a burp cloth overlying a shoulder of a caregiver and incorporating pockets in which heating or cooling pads can be inserted for the comfort of the infant being held against the upper torso of the caregiver; and U.S. Patent Publication No. 2016/0066629, of Karmen Marcum, et al, published on Mar. 10, 2016, disclosing a shoulder bib with a disposable and removable absorbent pad to protect the caregiver's underlying clothing.

Similarly, a disposable cover garment for protecting the underlying clothing of the caregiver is found in U.S. Pat. No. 6,345,392, granted on Feb. 12, 2002, to Fermina Rios, wherein the cover garment wraps around the caregiver's neck and overlaps the shoulders and the upper torso of the caregiver. U.S. Pat. No. 5,709,000, granted to Robin Hansen, et al, on Jan. 20, 1998, provides a similar structure to the Rios cover garment and includes a padded drool guard panel that wraps around the neck of the caregiver to provide comfort for the resting infant from the bony upper torso of the caregiver. The Hansen infant pillow and drool guard is formed with a washable fabric shell stuffed with a thick, soft batting.

It would be desirable to provide a garment that serves as a primary garment for a caregiver of a small infant and incorporates a padded upper torso area for the comfort of the infant and caregiver, from the bones in the caregiver's upper torso and baby's head, when the infant is being held by the caregiver.

SUMMARY OF THE INVENTION

It is an object of this invention to overcome the disadvantages of the known prior art devices by providing a primary garment incorporating a padded upper torso section to provide comfort to the caregiver and to the infant being held by the caregiver, while holding the infant against the upper torso of the caregiver.

It is another object of this invention to provide a garment for the caregiver of an infant that is formed with a padded upper torso portion of the garment.

It is a feature of this invention that the padded upper torso portion of the caregiver's garment can be manufactured in a stylish manner.

It is an advantage of this invention that the garment provides instant comfort to an infant being held against the upper torso of the caregiver.

It is another advantage of this invention that the caregiver can use a burp cloth over the padded upper torso of the garment whenever desired.

It is another feature of this invention that the padding is formed from batting encompassed within a shell of soft cotton blend material.

It is still another feature of this invention that the padding is sewn onto the underside of the garment shell, which in turn is sewn onto the exterior side of the garment shell.

It is still another advantage of this invention that the padding encompassed within the garment shell is shaped into a visually pleasing geometric pattern.

It is yet another advantage of this invention that the geometric pattern is formed by stitching passing through the exterior shell member, the padding and the interior shell member.

It is still another object of this invention that the garment incorporating a padded upper torso section can be formed as a nursing garment.

It is still another advantage of this invention that the caregiver does not have to search of a cover garment to provide comfort to the infant being held against the upper torso of the caregiver.

It is yet another object of this invention to provide a shirt that includes a padded torso section and is simple and effective in use.

These and other objects, features and advantages are accomplished according to the instant invention by providing a shirt incorporating a padded torso section formed with padding sewn onto an interior layer of an encompassing shell which in turn is sewn onto the exterior layer of the shell. Additional stitching passing through the padding and the interior and exterior layers of the shell can form a pleasing geometric pattern. The padded torso section provides comfort to the caregiver and to the infant resting on the torso of the caregiver. The padding can be secured to the interior shell member in a detachable manner to permit the removal of the padding from the upper torso section of the shirt. The shirt can be constructed as a nursing shirt, utilizing various forms of fasteners, and having an overlapping cover secured to the torso section to be used as a privacy cover.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENTS

Figures 1, 2, 9:
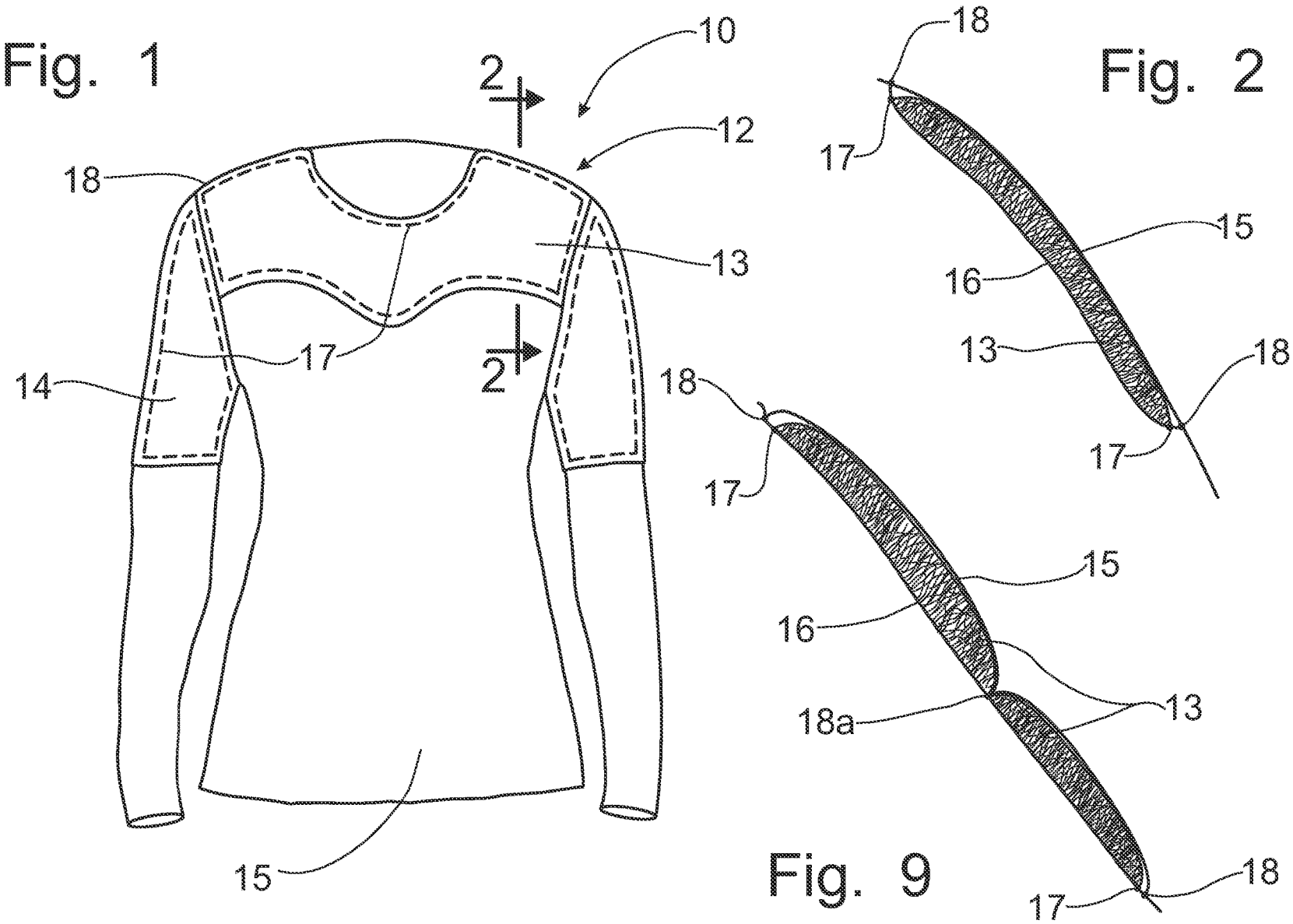
FIG. 1 is a front elevational view of a shirt having a padded torso section and incorporating the principles of the instant invention, optional padding being provided to the upper arm sections of the shirt.
FIG. 2 is a schematic cross-sectional view corresponding to lines 2-2 of FIG. 1 to shown the construction of the padded torso section.
FIG. 9 is a schematic cross-sectional view corresponding to lines 9-9 of FIG. 5 to show the construction of the padded torso section.

Referring now to the drawings, the details of a shirt having a padded upper torso section and incorporating the principles of the instant invention can best be seen. In the examples shown in the drawings, each shirt is formed with a padded upper torso section in which the padding will correspond to areas on which an infant will rest on the torso of the caregiver. Preferably, the upper torso section of the shirt is sewn together in such a way as to establish a geometric pattern that is pleasing to the eye of the caregiver to provide a styling for the shirt that will be desired by purchasers of the shirt. One skilled in the art will recognize that the shirt can be worn by either women or men to provide comfort to the infant for which they are providing care.

Figure 4:
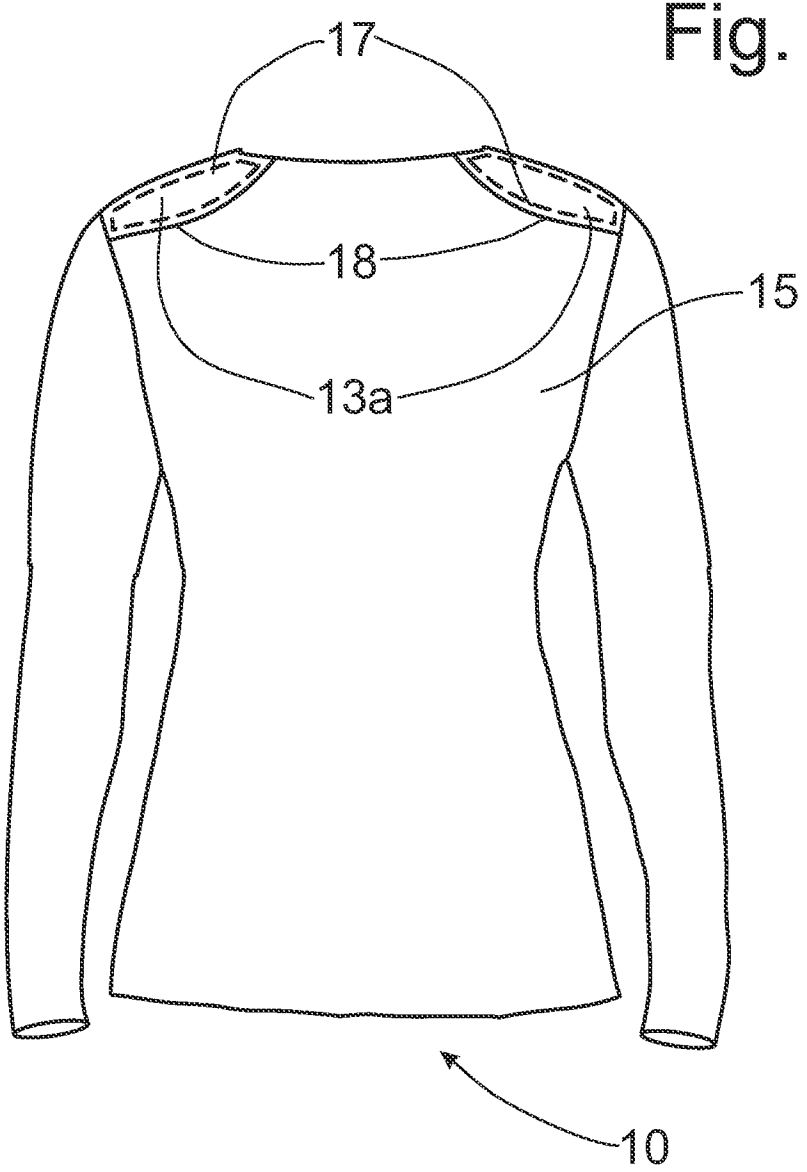
FIG. 4 is a rear elevational view of the shirt shown in FIG. 1.
Figure 3:
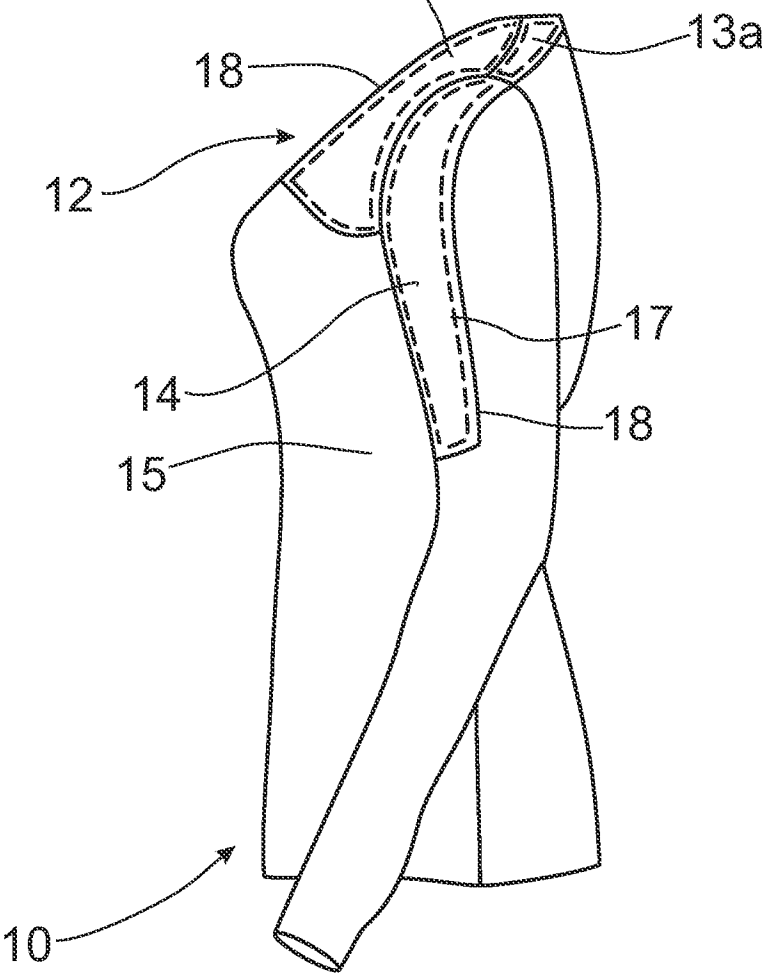
FIG. 3 is a left side elevational view of the shirt shown in FIG. 1.

Different configurations of the shirt 10 with a padded upper torso section 12 can be seen in the drawings. A first configuration of a shirt 10 incorporating the principles of the instant invention is best seen in FIGS. 1, 3 and 4. In this first configuration of the shirt 10, the padded upper torso section 12 is defined as a solid area of padding 13 from the shoulders to the breasts and includes optional padding 14 on the upper arms and padding 13*a* overlapping the top of the shoulders onto the back. As an alternative, the padding 13 can be secured to the interior shell member 16 by a detachable fastening device, such as a plurality of hook and loop fasteners, rather than being stitched onto the interior shell member 16. In such an alternative arrangement, the padding 13 would be removable from the shirt 10 to facilitate replacement and possibly laundering.

A schematic cross-sectional view corresponding to lines 2-2 on FIG. 1 demonstrates the construction of the padded upper torso section 12. The body 15 of the shirt 10 is formed of a comfortable material in a normal and conventional manner, such as a cotton, bamboo and Spandex blend, that is comfortable on the skin of the caregiver. The same material is preferably used as the interior shell member 16 to which the padding 13 is sewn at stitch lines 17 to secure the padding 13 to the interior shell member 16 around the perimeter of the padding 13. The padding material is preferably formed of 3 Denier batting-like polyester material, or other suitable material, which creates a padding 13 that can provide a layer of comfort between the infant and the body of the caregiver. The interior shell member 16 carrying the padding 13 is then sewn to the body 15 by stitching along lines 18 to create a padded upper torso section 12 having the padding material housed within a shell formed by the interior shell member 16 and the exterior body 15 of the shirt 10 forming an external shell member.

Figure 6:
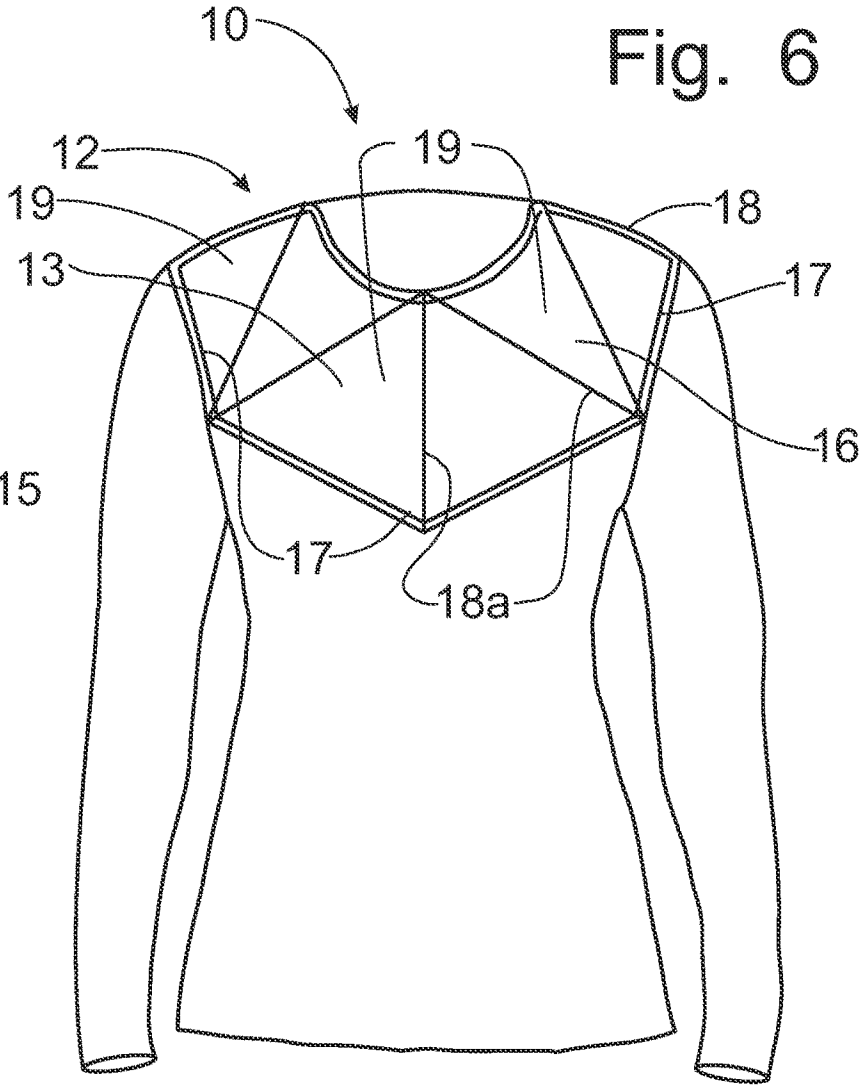
FIG. 6 is a rear elevational view of the padded torso section forming the interior view of the shirt depicted in FIG. 5.
Figure 5:
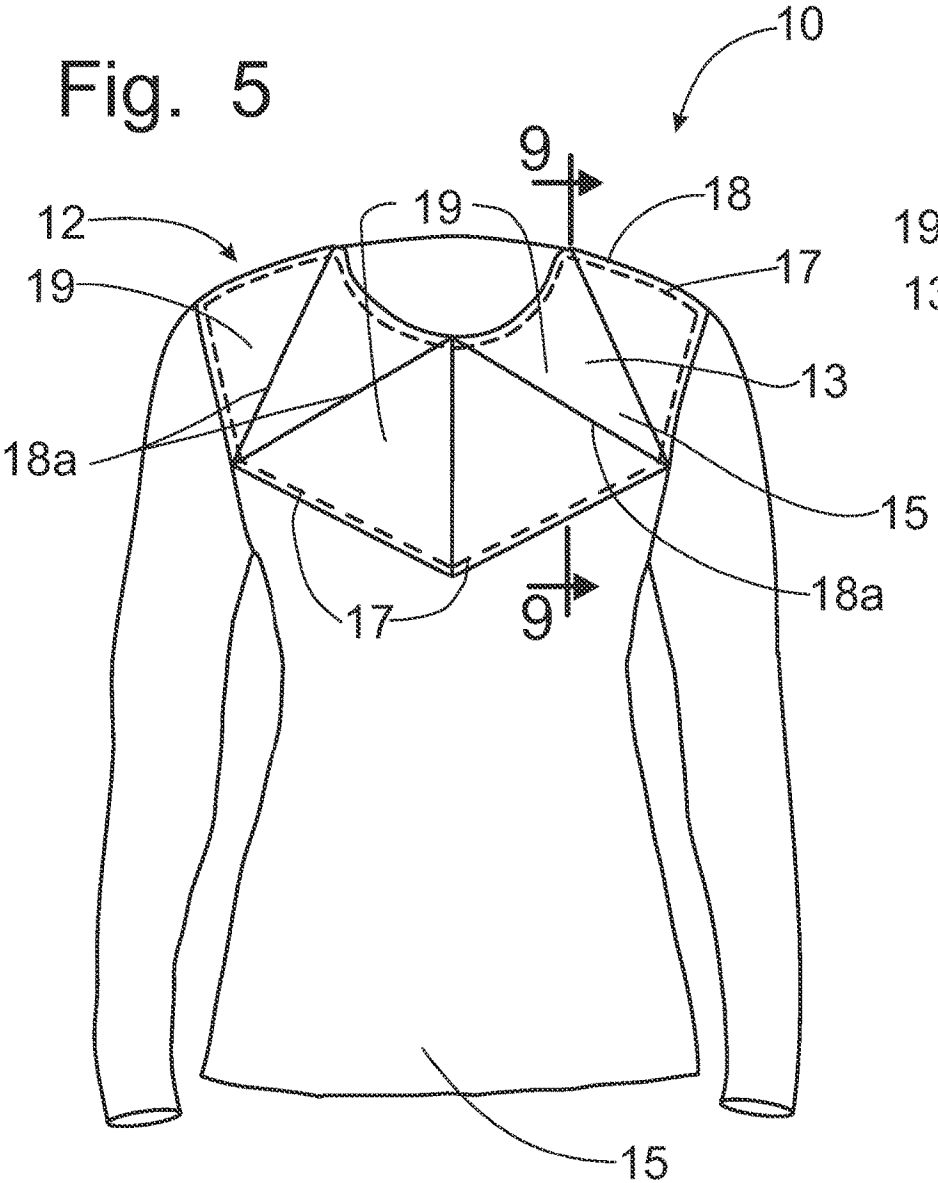
FIG. 5 is a front elevational view of a shirt incorporating the principles of the instant invention and having a geometric pattern formed in the padded torso section.

Referring now to FIGS. 5 and 6, an alternative configuration of the instant invention can best be seen. The padded upper torso section 12 of the shirt 10 is formed into a stylish geometric pattern. Preferably, the padding 13 is shaped and sized to cover the entire upper torso section to be padded, and then connected to an interior shell member 16 that is slightly larger than the padding 13 so that the interior shell member 16 can be stitched to the body 15 around the perimeter of the interior shell member 16 by a line of stitching 18. The pattern of geometric members 19 can then be created by stitching 18*a* that passes through the body 15, padding 13 and the interior shell member 16, forming a depression into the padded upper torso section 12.

As is represented in FIG. 9, the construction of the individual geometric members 19 is essentially the same as described above with respect to the cross-section in FIG. 2. The padding material, preferably formed of 3 Denier batting-like polyester material, is joined to the interior shell member 16 and encased between the body 15 and the interior shell member 16. The result of the stitching line 18*a* is the formation of a stylishly pleasing geometric pattern while maintaining the layer of comfortable padding 13 for the infant to rest against while the caregiver is holding the infant along the padded upper torso section 12 of the shirt 10.

Figure 8:
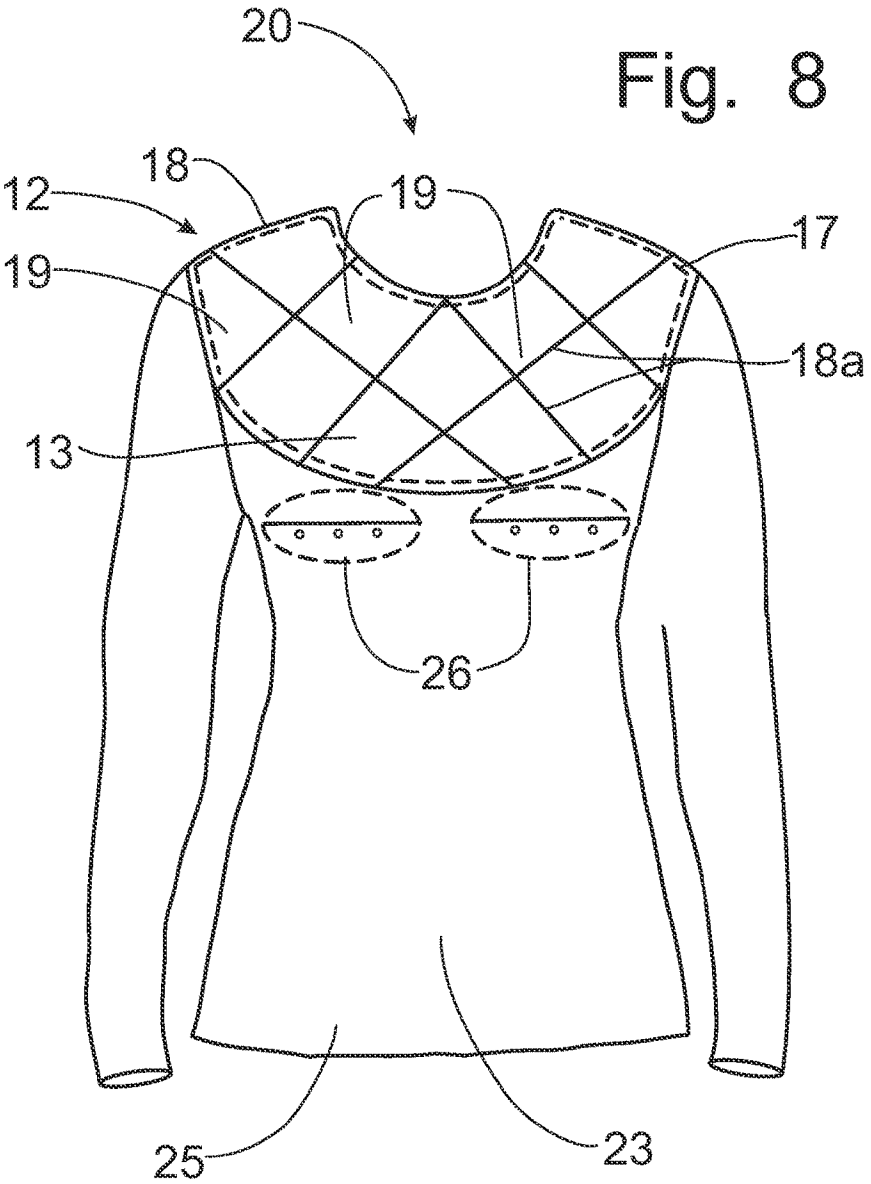
FIG. 8 is a front elevational view of the nursing shirt of FIG. 7 but having the front cover flap removed for purposes of clarity.
Figure 7:
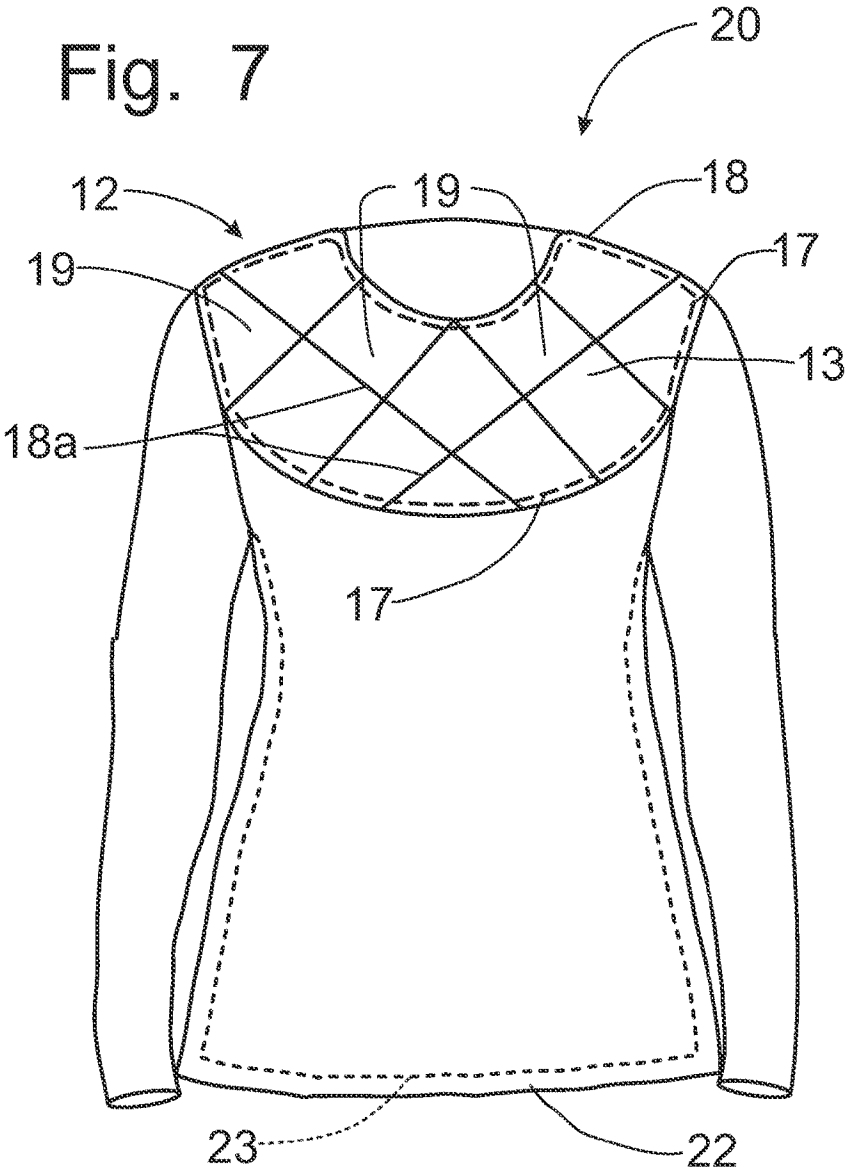
FIG. 7 is a front elevational view of a nursing shirt incorporating the principles of the instant invention, the padded torso section including a geometric pattern different from the shirt shown in FIG. 5.

A similar, yet different, padded upper torso section 12 is shown in FIGS. 7 and 8 depicting a nursing shirt 20. This nursing shirt 20 is formed with a modesty cover panel 22 sewn onto the front of the shirt 20 beneath the padded upper torso section 12 to overlie the lower section 23 of the nursing shirt 20 body 25. In FIG. 8, the cover panel 22 is removed to show the nursing features of the body 25 including openings 26 for the infant to access the mother's breasts for feeding. Preferably these openings 26 are closable through the use of known fasteners, such as snaps, zippers or hook and loop fasteners.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A shirt having a collar portion and a chest portion, comprising:

a body having an upper torso section, extending from said collar portion and terminating within said chest portion, and a lower torso section attached to and extending below said upper torso section;

a shell formed in at least a part of said upper torso section and including an interior shell member secured around a perimeter thereof to said body to form a chamber therebetween; and a padding member positionally fixed within said chamber to increase thickness of said at least a part of said upper torso section, said padding member extending to and along said collar portion on said upper torso section.

2. The shirt of claim 1 wherein said padding is shaped and sized to corresponding to said at least a part of the upper torso section to be padded and secured around a periphery of said padding to said interior shell member.

3. The shirt of claim 2 wherein said padding member is secured to the interior shell member by stitching.

4. The shirt of claim 2 wherein said padding member is secured to the interior shell member by detachable fastening devices.

5. The shirt of claim 3 wherein said upper torso section is divided into multiple geometric portions by lines of stitching connecting said interior shell member to said body.

6. The shirt of claim 5 wherein said lines of stitching forming the geometric pattern extends through said body, said padding and said interior shell member.

7. The shirt of claim 2 further comprising a modesty cover panel secured to said body to cover said lower torso section, said body having a pair of nursing openings formed in said lower torso section.

8. The shirt of claim 2 further comprising a pair of sleeves connected to said upper torso section, each said sleeve having an area thereof provided with a shell forming a chamber between the corresponding said interior shell member and said sleeve within which padding is secured, said padding not fully covering said chest portion.

9. A method of forming a shirt for wear by a caregiver of an infant, comprising the steps of:

forming a front portion of a body of said shirt to have an upper torso section extending from a collar portion of said shirt and terminating within a chest portion of said shirt, and a lower torso section, attached to and extending below said upper torso portion;

providing an interior shell member corresponding to at least a part of said upper torso section to create a chamber between said interior shell member and said front portion and extending to and along said collar portion;

shaping and sizing padding material into a form that corresponds to said chamber between said at least a portion of said upper torso section and said interior shell member;

securing said padding material to said interior shell member around a periphery of said padding material, such that said padding material extends to and along said collar portion; and connecting said interior shell member to said upper torso section around a periphery of said interior shell member.

10. The method of claim 9 further comprising the step of sewing the front panel of said body to a rear panel of said body to form said shirt.

11. The method of claim 9 wherein said step of securing said padding material includes stitching said padding material to said interior shell member.

12. The method of claim 11 wherein said connecting step includes stitching said interior shell member to said body along said collar portion.

13. The method of claim 9 wherein said step of securing said padding material includes attaching said padding material to said interior shell member by detachable fastening devices.

14. The method of claim 13 wherein said connecting step includes connecting said interior shell member to said body with detachable fastening devices to permit removal of said padding material from said shirt.

15. The method of claim 9 wherein said portion of said upper torso section is formed into a geometric pattern by forming lines of stitching through said upper torso section, said lines of stitching passing through said body, said padding material and said interior shell member.

16. A nursing shirt for use by a mother nursing an infant, comprising:

a body having an upper torso section and a lower torso section, said body portion having a pair of nursing openings formed in said lower torso section;

an interior shell member secured to said upper torso section of said body to form a chamber therebetween; and a padding member shaped to correspond to said interior shell member and being sized to be secured to said interior shell member along the periphery of said interior shell member, said padding member being positionally secured to said interior shell member and located within said chamber to increase thickness of said upper torso section and provide comfort for the infant resting against said upper torso section.

17. The nursing shirt of claim 16 wherein said upper torso section is divided into a geometric pattern defining a plurality of individual geometric sections by lines of stitching passing through said body, said padding member and said interior shell member.

18. The nursing shirt of claim 16 wherein said padding member is secured to said interior shell member and said interior shell member is secured to said body by stitching extending around a periphery of each of said padding member and said interior shell member, respectively.

19. The nursing shirt of claim 16 wherein said padding member is secured to said interior shell by a plurality of detachable fastening devices extending around a periphery of said padding member, said interior shell member being secured to said body, at least in part, by detachable fastening devices to permit the removal of said padding member from said shirt.

20. The nursing shirt of claim 16 further comprising a modesty cover panel secured to said body and covering at least a portion of said lower torso section.

* * * * *